US011485914B2

(12) United States Patent
Cintula et al.

(10) Patent No.: US 11,485,914 B2
(45) Date of Patent: Nov. 1, 2022

(54) PROCESS AND SYSTEM FOR RECOVERING HYDROCARBONS FROM OIL SAND AND OIL SHALE

(71) Applicant: COMPOSITE RECYCLING CORP., Calgary (CA)

(72) Inventors: Roman Cintula, Calgary (CA); Frank Riedewald, Cork City (IE)

(73) Assignee: COMPOSITE RECYCLING CORP., Calgary (CA)

( * ) Notice: Subject to any disclaimer, the term of this patent is extended or adjusted under 35 U.S.C. 154(b) by 0 days.

(21) Appl. No.: 16/824,837

(22) Filed: Mar. 20, 2020

(65) Prior Publication Data

US 2020/0299590 A1 Sep. 24, 2020

Related U.S. Application Data

(60) Provisional application No. 62/820,953, filed on Mar. 20, 2019.

(51) Int. Cl.
*C10G 9/36* (2006.01)

(52) U.S. Cl.
CPC ..... *C10G 9/36* (2013.01); *C10G 2300/10* (2013.01); *C10G 2300/4006* (2013.01)

(58) Field of Classification Search
None
See application file for complete search history.

(56) References Cited

U.S. PATENT DOCUMENTS

| | | | | |
|---|---|---|---|---|
| 1,009,386 | A | 11/1911 | Davis et al. | |
| 2,931,843 | A | 4/1960 | Bruns | |
| 3,696,166 | A | 10/1972 | Ozawa et al. | |
| 4,160,720 | A | 7/1979 | Seader et al. | |
| 4,214,113 | A | 7/1980 | Khmelevskaya et al. | |
| 4,280,879 | A | 7/1981 | William et al. | |
| 4,285,773 | A | 8/1981 | William et al. | |
| 4,289,731 | A | 9/1981 | Khmelevskaya et al. | |
| 4,421,631 | A | 12/1983 | Ampaya et al. | |
| 4,505,810 | A | 3/1985 | Plummer et al. | |
| 5,217,578 | A | 6/1993 | William et al. | |
| RE42,832 | E | 10/2011 | Nagel et al. | |
| 2007/0090017 | A1* | 4/2007 | Maxwell | B01J 19/0066 208/106 |
| 2008/0307703 | A1 | 12/2008 | Dietenberger et al. | |
| 2010/0050466 | A1 | 3/2010 | Titmas | |
| 2012/0193271 | A1 | 8/2012 | McCutchen et al. | |
| 2013/0233772 | A1 | 9/2013 | Jordan et al. | |
| 2015/0151274 | A1 | 6/2015 | Lee et al. | |
| 2015/0184079 | A1 | 7/2015 | Riedewald | |

(Continued)

FOREIGN PATENT DOCUMENTS

| | | | |
|---|---|---|---|
| CA | 2679729 | C | 9/2008 |
| CA | 2783053 | A1 | 1/2013 |

(Continued)

*Primary Examiner* — Tam M Nguyen
(74) *Attorney, Agent, or Firm* — MBM Intellectual Property Law LLP

(57) ABSTRACT

This invention relates to the recovery of hydrocarbons i.e. to a process and system for the production of synthetic crude oil from unconventional oil sources such as oil sands, oil shale, and similar materials. The process comprises pyrolysing the feedstock in a pyrolysis liquid comprising molten metal(s) or molten salt (s).

18 Claims, 12 Drawing Sheets

(56) References Cited

U.S. PATENT DOCUMENTS

| | | | | |
|---|---|---|---|---|
| 2016/0030987 | A1 | 2/2016 | Riedewald | |
| 2016/0312126 | A1 | 10/2016 | Wormsbecker et al. | |
| 2021/0009903 | A1* | 1/2021 | Harandi | B01J 8/1809 |

FOREIGN PATENT DOCUMENTS

| | | | |
|---|---|---|---|
| EP | 0395486 | A3 | 10/1990 |
| RU | 1809834 | A3 | 4/1993 |
| WO | 2014032843 | A1 | 3/2014 |
| WO | 2014167139 | A2 | 10/2014 |

* cited by examiner

▽ indicates the molten metal level in operation

Fig. 5 view A-A of Fig. 4
Arrows "121" indicate the direction of flow within the pyrolysis chamber (10)

Fig. 7 - View A-A of Fig. 6

▽ indicates the molten salt level in operation

PROCESS AND SYSTEM FOR RECOVERING HYDROCARBONS FROM OIL SAND AND OIL SHALE

FIELD OF THE INVENTION

This invention relates to the recovery of hydrocarbons from oil sands, oil shale, and similar materials, and from unconventional oil sources such as lignite, heavy hydrocarbon residues, and similar materials.

BACKGROUND

Oil sands, also known as tar sands are a type of petroleum deposit. Oil sands are either loose sands or partially consolidated sandstone containing a naturally occurring mixture of sand, clay, and water, saturated with a dense and extremely viscous form of petroleum product generally referred to as bitumen (or colloquially as tar due to its superficially similar appearance).

The Athabasca deposit located in the province of Alberta is the main Canadian oil sands deposit and the only one currently exploited on a large scale. The composition of Athabasca oil sands is approximately 80-85% silica sand, clay and silt, 5% water, and 10-15% bitumen. The average sand grain size diameter is 0.5 mm Generally, bitumen is extracted from Athabasca oil sands by the hot water for surface mining or by a steam extraction process i.e. steam assisted gravity drainage.

Oil shale is commonly defined as a fine-grained sedimentary rock containing organic matter called kerogen that yields oil and combustible gas upon destructive distillation. Oil shale is mined using either underground- or surface-mining methods.

Oil sands and oil shale are required to be processed to separate the oil from its source rocks and sands which is then upgraded and refined to produce a commercial product.

Pyrolysis (also referred to as thermolysis or thermal cracking) is a thermochemical decomposition process is carried out at elevated temperatures in the absence of oxygen. The desired product of oil source pyrolysis is pyrolysis oil, also referred to as synthetic oil.

Several processes and systems have been developed in an attempt to extract hydrocarbons from oil sands and shale oil.

The Alberta Taciuk Process (ATP) is disclosed in a number of US patents such as U.S. Pat. Nos. 4,280,879, 4,285,773 entitled "Apparatus and process for recovery of hydrocarbons from inorganic host material" and U.S. Pat. No. 5,217,578 entitled "Dry thermal processor". These patents disclose complicated dry thermal processors for recovering hydrocarbons from oil sands. The processes disclosed in these patents employ an indirectly heated pyrolysis unit, i.e. a rotary kiln, which produces coked solids. The processers disclosed in these patents also include a combustion chamber, wherein some of the coke and residual bitumen of the previously pyrolysed sand is combusted to provide energy for the pyrolysis process. The processes disclosed in these patents result in loss of heat energy, are not cost effective.

US Publication No. 2010/0050466, entitled "Retort apparatus and method for continuously processing liquid and solid mixtures and for recovering products therefrom" discloses another pyrolysis system i.e. a rotary kiln. Such a process has the same disadvantages as the ATP process.

US Publication No. 2012/0193271, entitled "Mechanical pyrolysis in a shear retort" discloses a system in which the oil sands are exposed to high mechanical shear stresses in a shear retort. The water inherently present in most oil sands is evaporated and the oil freed by heat generated by the grinding action of the sand particles. The main difficulty associated with this system is that the motor provides the required heat energy by converting electrical energy to heat energy which is inefficient and results in large losses of energy.

US Publication No. 2013/0233772, entitled "Extraction of oil from oil sands" discloses a fluidised bed pyrolysis system to recover oil from oil sands. The fluidised bed can either be a dilute or a dense phase bed.

U.S. Pat. No. 4,160,720, entitled "Process and apparatus to produce synthetic crude oil from tar sands" is another pyrolysis process in form of a fluidised bed, which is located above another fluidised bed in which the treated tar sands are combusted providing the energy for the fluidised bed pyrolysis process. The heat from the combustion fluidised bed is transported to the pyrolysis fluidised bed by heat pipes. US Publication No. 2016/0312126, entitled "Fluid coking process" discloses another fluidised bed system for heavy petroleum feeds such as asphaltenes or non-distillable residues which are converted into lighter oils. This patent claims that this system results in improved liquid yields compared to the Flexicoking™ process, which is applied commercially. The main disadvantages of fluidised bed processes as exemplified by the above patents are (1) poor heat transfer between the gas and solid phase and (2) the solid particles have to be in a relatively narrow particle size distribution in order for the fluidised bed to process to operate properly.

US Publication No. 2007/090017 discloses an apparatus and a process for the thermal cracking of hydrocarbonaceous material (such as old tires, plastic scrap, other wastes, and spent lubricating fluids) over a surface of molten metal, such as lead. The apparatus has a first reaction zone wherein the hydrocarbonaceous materials are introduced, and volatilized, and a second zone, where volatilized hydrocarbonaceous materials from the first zone are subjected to conditions sufficient for thermal cracking of the volatilized hydrocarbonaceous materials. The temperature in the second zone is maintained sufficient for thermal cracking by the heat from the underlying molten metal surface. A conveyor is provided to convey the molten metal surface in a continuous recirculating pattern in the containment. A skimmer system is provided for removing carbon and other solid materials from the surface of the molten metal as the conveyor conveys the molten metal by the skimmer.

There is therefore a need for a process and a system for recovering hydrocarbons from oil sands and/or oil shale that would be more efficient and more cost effective than indirectly heated rotary kiln operations or convention oil sand operations.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide an economic process and system for recovering a hydrocarbon product from a feedstock comprising oil sand, oil shale source material, and similar materials, and from unconventional oil sources such as lignite, heavy hydrocarbon residues, and similar materials.

In accordance with an aspect of the present invention, there is provides a process of recovering a hydrocarbon product from a feedstock comprising an oil sand, an oil shale source material, lignite, or heavy hydrocarbon residue, the process comprising:

removing air from the feedstock;

introducing the feedstock in a pyrolysis chamber containing a pyrolysis liquid comprising a molten metal, the pyrolysis chamber being maintained at a temperature sufficient to pyrolyze the feedstock;

contacting the feedstock with the pyrolysis liquid for a time sufficient to convert the feedstock into pyrolysis vapour products comprising the one or more hydrocarbons, and a solid pyrolysis residue which floats on the surface of the pyrolysis liquid;

removing the pyrolysis vapour products and the solid pyrolysis residue together from the surface of the pyrolysis liquid via suction;

separating the solid pyrolysis residue from the pyrolysis vapour products; and recovering the one or more hydrocarbons from the pyrolysis vapour product.

In accordance with another aspect of the invention, there is provided a process of recovering a hydrocarbon product from a feedstock comprising an oil sand, an oil shale source material, lignite or heavy hydrocarbon residue, the process comprising:

removing air from the feedstock;

introducing the feedstock in a pyrolysis chamber containing a pyrolysis liquid comprising a molten salts, the pyrolysis chamber being maintained at a temperature sufficient to pyrolyze the feedstock;

contacting the feedstock with the pyrolysis liquid for a time sufficient to convert the feedstock into pyrolysis vapour products comprising one or more hydrocarbons and a solid pyrolysis residue;

allowing the solid pyrolysis residue to sink towards the bottom of the pyrolysis chamber;

removing the pyrolysis vapour product from the pyrolysis liquid via suction;

removing the solid pyrolysis residue via a solid residue removal line/conduit or device; and recovering the one or more hydrocarbons from the pyrolysis vapour products.

In accordance with another aspect of the invention, there is provided a system for recovering a hydrocarbon product from a feedstock comprising an oil sand, an oil shale source material, lignite, or heavy hydrocarbon residue, the system comprising:

a pryrolysis chamber for containing a pyrolysis liquid during operation, the pyrolysis chamber having a top, a bottom opposed to the top, a first side wall and a second side wall opposed the first side wall, the first and second side wall each extending between the top and the bottom, a charging vessel for removing air from the feedstock, and equipped with means for introducing/charging the feedstock from the charging vessel into the pyrolysis chamber; the charging vessel being in communication with the pyrolysis chamber at a charging end thereof, the charging end being located at the top or at an upper part of the first side wall of the pyrolysis chamber;

a heating system for heating and maintaining the pyrolysis liquid in a liquid state at a temperature at which the feedstock undergoes pyrolysis to form the pyrolysis vapour products and the solid pyrolysis residue; and an extraction system comprising one or more vapour/solid removal system in fluidic communication with the pyrolysis chamber via the top for removing pyrolysis vapours products and solid pyrolysis residue together from the surface of the pyrolysis liquid via suction; or an extraction system comprising a vapour removal system in fluidic communication with the pyrolysis chamber via the top for removing pyrolysis vapours products from the pyrolysis liquid via suction, and a removal device configured to extend into the pyrolysis liquid for removing the solid pyrolysis residue from the pyrolysis chamber.

Numerous other features, objects and advantages of the invention will become apparent from the following description when read in conjunction with the accompanying drawings.

DETAILED DESCRIPTION

Definitions

Figure 1:
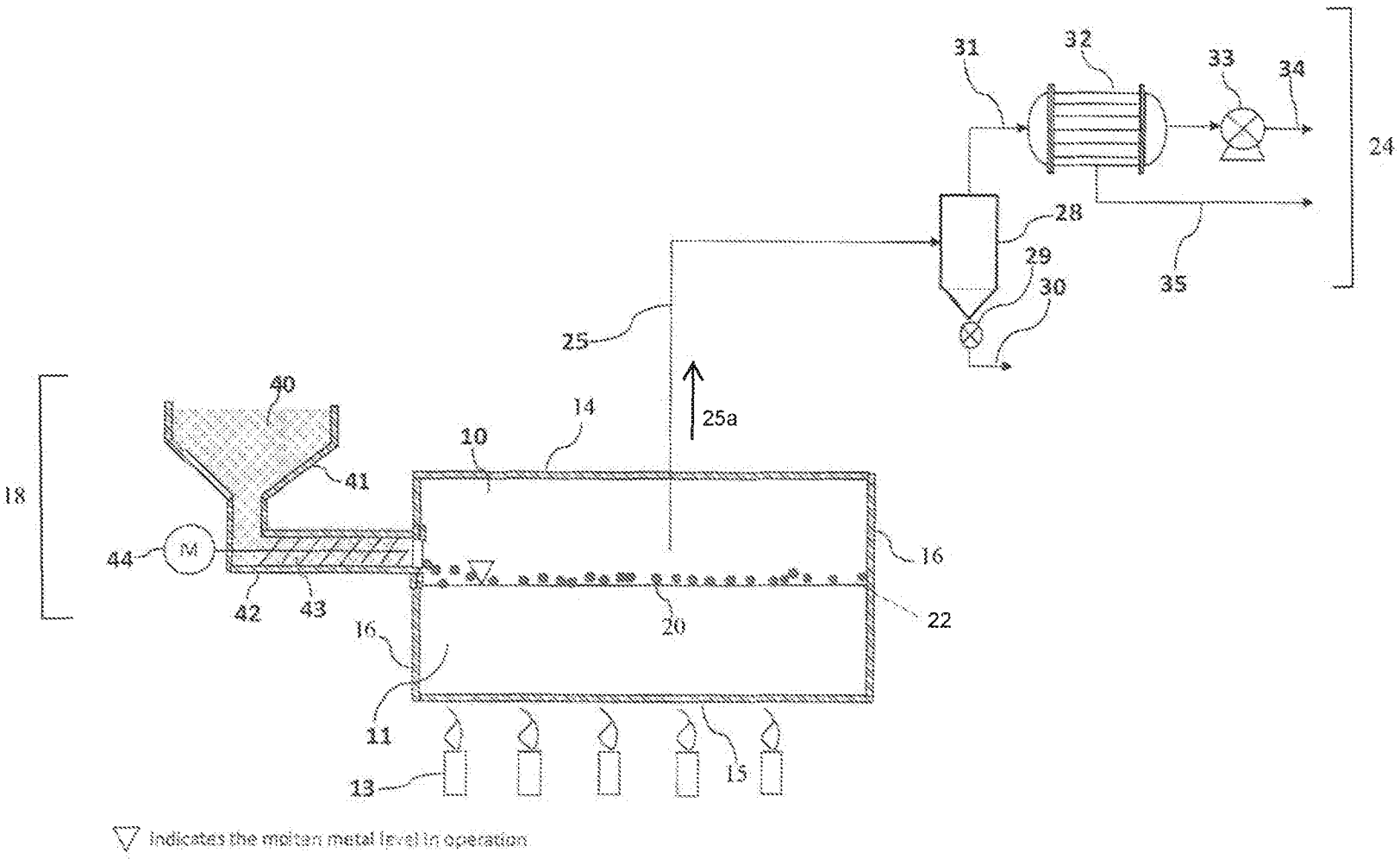
FIG. 1 illustrates a schematic view of a system in accordance with an embodiment of the present invention.

Unless defined otherwise, all technical and scientific terms used herein have the same meaning as commonly understood by one of ordinary skill in the art to which this invention belongs.

The phrase "feedstock comprising oil sand" used herein refers to a feedstock comprising oil-impregnated sandstone, oil tar, tar sands, bituminous sand, "oil sand tailing", and like".

The phrase "oil sand tailings" refers to a mixture of water, sand, clay and residual bitumen, which is the by-product of the hot water treatment process used to separate the oil from sand and clay in oil sands mining operations, and are typically stored in "tailing ponds".

The phrase "oil shale source material" refers to a mixture of organic chemical compounds (such as kerogen) obtained from oil shale rock formations.

The term "lignite" used herein may refer to brown coal, which is a combustible, sedimentary rock formed from naturally compressed peat.

The term "heavy hydrocarbon residue" used herein may refer to "asphaltenes", "non-distillable bottoms", and/or "residuum" obtained during processing of bitumen and heavy oil.

The term "asphaltenes", refers to complex, varied, large organic compounds and are present in most petroleum materials, but especially in all heavy oils and bitumens from oil sands. Asphaltenes are defined operationally as the n-heptane ($C_7H_{16}$)-insoluble, toluene ($C_6H_5CH_3$)-soluble component of a carbonaceous material such as crude oil, bitumen, or coal.

The term "non-distillable bottoms" refers to non-distillable residue left after atmospheric and/or vacuum distillation of bitumen or heavy oil.

The term "residuum" refers to the left over material remaining after hydrocarbons, bitumen and heavy oil processing operations, such as desulfurization, demetallization, Conradson Carbon reduction, solvent deasphalting, or combinations thereof.

Pyrolysis refers to a thermochemical decomposition process at elevated temperatures in the absence of oxygen/under an inert atmosphere.

The terms "comprise", "comprises", "comprised" and "comprising" or any variation thereof and the terms "include", "includes", "included" and "including" any variation thereof are considered to be totally interchangeable and they should all be afforded the widest possible interpretation and vice versa.

The present invention provides a cost effective and efficient process and system for recovering hydrocarbons from oil sand, oil shale material sources and other unconventional feedstocks such as lignite and heavy hydrocarbon residue using molten metal or molten salts for pyrolysis, along with having the advantages of recovering a much higher percentage of desired hydrocarbons, and not producing tailing ponds associated with previously known oil sand processing methods.

The inventors of the present application have surprisingly found that direct pyrolysis of oil sand, shale oil source materials and other unconventional feedstocks, such as lignite or heavy hydrocarbon residue, in molten metal or molten salts, provides for efficient separation of the resulting pyrolysis vapours (comprising hydrocarbons and other vapors/gases such as $H_2$, CO, $CO_2$, $H_2O$, etc.), and solid residue (comprising carbon, char, sand and other components), which leads to improved yield of recovered hydrocarbons, and cleaner solid residue as compared to oil sand tailings obtained in previously known oil sand processing methods. The solid residue obtained in the process of the present application can be disposed of without requiring further treatments. In addition, generation of waste water contaminated with oil is substantially reduced by the process of the present invention.

In particular, extraction of pyrolysis vapours and the solid pyrolysis residue together from the pyrolysis liquid, followed by a further separation process outside the pyrolysis chamber provides for complete separation of the vapours from the solid residue.

In the process of recovering one or more hydrocarbon products from a feedstock comprising an oil sand, an oil shale source material, lignite, or heavy hydrocarbon residue, in accordance with the present invention, the feedstock is contacted with a pyrolysis liquid in an inert atmosphere, in a pyrolysis chamber maintained at a temperature sufficient to pyrolyze the feedstock. The feedstock is maintained in the pyrolysis liquid for a time sufficient to convert the feedstock into a pyrolysis vapour products comprising hydrocarbons and a solid pyrolysis residue, followed by separating the pyrolysis vapour products from the solid pyrolysis residue. The pyrolysis vapour products are further processed to recover desired hydrocarbons.

The temperature of the pyrolysis chamber is maintained at a temperature in the range of 400-750° C., preferably 400-550° C.

In some embodiments, the pressure inside the pyrolysis chamber is maintained at atmospheric pressure. In some embodiments, the pressure inside the pyrolysis chamber is maintained up to 500 mbar above the atmospheric pressure. In some embodiments, the pressure inside the pyrolysis chamber is maintained up to 100 mbar above the atmospheric pressure. In some embodiments, the pressure inside the pyrolysis chamber is maintained up to 50 mbar above the atmospheric pressure.

The pyrolysis liquid can comprise one or more molten metals or molten salts.

In the process involving a pyrolysis liquid comprising molten metal, the solid pyrolysis residue floats on the surface of the pyrolysis liquid, and the process further comprises removing the pyrolysis vapour products and the solid pyrolysis residue together from the surface of the pyrolysis liquid, followed by separating the solid pyrolysis residue from the pyrolysis vapour products, and recovering the hydrocarbons from the pyrolysis vapour product.

In one embodiment, the pyrolysis vapour products and the solid pyrolysis residue are removed together from the surface of the pyrolysis liquid via suction.

In some embodiments the above described process, the pyrolysis vapour product and the solid pyrolysis residue are removed from the pyrolysis chamber via a solid/vapour extractor system comprising a suction fan. In some embodiments, the solid/vapour extractor system further comprises a cyclone and/or a condenser system.

In some embodiments, after removal of the pyrolysis vapour products and the solid residue from the pyrolysis chamber, the solid pyrolysis residue is separated from the pyrolysis vapour products via a cyclone. In some embodiments, the cyclone temperature is maintained at the same or slightly lower temperature as the pyrolysis chamber.

In some embodiments, the process further includes separating hydrocarbon liquids and non-condensable hydrocarbon gases from the pyrolysis vapour products via a condenser system. In some embodiments, the non-condensable hydrocarbon gases are recycled for heating pyrolysis liquid.

Any molten metal can be used in the process of the present invention. In some embodiments, the molten metal is one or more of molten zinc, molten tin, molten lead, molten aluminum, or alloys thereof. In some embodiments, the molten metal is molten zinc, molten lead or an alloy thereof.

In the process involving a pyrolysis liquid comprising molten salt, the pyrolysis residue is allowed to sink towards the bottom of the pyrolysis chamber, followed by removing the pyrolysis vapour product from the pyrolysis liquid, removing the solid pyrolysis residue via a solid residue removal line or device, and recovering the hydrocarbons from the pyrolysis vapour products.

In one embodiment, the pyrolysis vapour products are removed from the surface of the pyrolysis liquid via suction.

In some embodiments of the process involving molten slats, the pyrolysis vapour products are removed from the pyrolysis chamber via a vapour extractor system comprising a suction fan. In some embodiments, the vapour extractor system further comprises a cyclone and/or a condenser system.

The solid residue that has sunk towards the bottom and/or collected at the bottom of the pyrolysis chamber can be removed using a mechanical device or a solid removal conduit.

Any molten salt can be used in the process of the present invention. In some embodiments, the molten salts are lithium salts, preferably LiCl-KCl. The molten salt may be the eutectic or near eutectic mixture of LiCl-KCl consisting of 58.2 mol % LCl and 41.8 mol % KCl. Other suitable salt mixtures are ternary nitrate-nitrite salts, for example sodium nitrate-sodium nitrite-potassium nitrate ($NaNO_3$—$NaNO_2$—$KNO_3$).

In some embodiments, the air from the feedstock can be removed by a vacuum pump and subsequently purged/broken with an inert gas, such as nitrogen and argon to achieve an inert atmosphere. Other ways of removing air from the feedstock, for example, by displacement, dilution, pressure swing purging or combinations thereof, can also be used.

The process comprises introducing the feedstock onto and/or below the surface of the pyrolysis liquid in the pyrolysis chamber.

In some embodiments, the feedstock is introduced onto the surface of the pyrolysis liquid via at least one feeding member adapted to remove air from the feed stock. The feeding member can be at least one screw feeder or at least one delivery line/conduit.

In some embodiments, the feedstock is pumped below the surface of the pyrolysis liquid via the at least one delivery line/conduit. In some embodiments, the delivery line/conduit is configured to introduce the feedstock at multiple depths below the surface of the pyrolysis liquid.

In some embodiments, the feedstock is introduced to a delivery site in the pyrolysis chamber, and the pyrolysis vapour products and the solid pyrolysis residue are removed from a removal site in the pyrolysis chamber. In some embodiments, the delivery site is located at one side of the pyrolysis chamber, and the removal site is located at an opposing side of the pyrolysis chamber. In some embodiments, the delivery site is located at a middle portion of the top of the pyrolysis chamber, and the removal site is located at the side ends of the pyrolysis chamber.

In some embodiments, the process includes moving the feedstock from the delivery site through the pyrolysis chamber towards the removal site by moving the surface of the pyrolysis liquid, for example, via centrifugal pump and/or by electromagnetic induction.

In another aspect of the present invention, there is provided a system for executing the process of the present invention. The system comprises a pyrolysis chamber for containing a pyrolysis liquid during operation; a charging vessel for removing air from the feedstock, the charging vessel being equipped with means for charging the feedstock from the charging vessel into the pyrolysis chamber; a heating system for heating and maintaining the pyrolysis liquid in a molten state at a temperature at which the feedstock undergoes pyrolysis to form the pyrolysis vapour products and the solid pyrolysis residue; and an extraction system.

In some embodiments, the pyrolysis chamber has a top, a bottom opposed to the top, a first side wall and a second side wall opposed the first side wall, the first and second side wall each extending between the top and the bottom. The charging vessel is positioned in communication with the pyrolysis chamber at a charging end of the charging vessel. The charging end is located at the top or at an upper part of the first side wall of the pyrolysis chamber.

The extraction system comprises one or more vapour/solid removal lines/conduits in fluidic communication with the pyrolysis chamber for removing pyrolysis vapours products and solid pyrolysis residue together from the surface of the pyrolysis liquid. Alternatively, the extraction system comprises one or more vapour removal lines/conduits in fluidic communication with the pyrolysis chamber for removing pyrolysis vapours products from the pyrolysis liquid, and a removal device or line configured to extend into the pyrolysis liquid for removing the solid pyrolysis residue from the pyrolysis chamber.

In one embodiment, vapour/solid removal lines/conduits or vapour removal lines/conduits are positioned to be in communication via upper side wall of the pyrolysis chamber.

The charging means are positioned to introduce the feedstock onto and/or below the surface of the pyrolysis liquid in the pyrolysis chamber.

In some embodiments, the charging means comprises least one feeding member adapted to remove air from the feedstock. The at least one feeding member can be at least one screw feeder, or at least one delivery line/conduit. In some embodiments, the at least one delivery line/conduit is configured to introduce the feedstock at multiple depths below the surface of the pyrolysis liquid.

In some embodiments, the charging means are positioned to introduce the feedstock to a delivery site in the pyrolysis chamber, and the extraction system is positioned to remove the pyrolysis vapour products and the solid pyrolysis residue at two or more separate removal sites in the pyrolysis chamber.

In some embodiments, the delivery site is located at one side of the pyrolysis chamber, and the charging means comprises a continuous charging mechanism equipped with a conveyor for introducing the feedstock into the pyrolysis liquid.

In some embodiments, the feedstock feeding member comprises a conveyor belt within a sealed conduit.

In some embodiments, the extraction system is positioned to remove the pyrolysis vapour products and the solid pyrolysis residue together from a removal site in the pyrolysis chamber.

In some embodiments, the delivery site is located at one side of the pyrolysis chamber, and the removal site is located at an opposing side of the pyrolysis chamber. In some embodiments, the delivery site is located at a middle portion of the top of the pyrolysis chamber, and the removal site is located at the side ends of the pyrolysis chamber.

In some embodiments, the extraction system is positioned to remove the pyrolysis vapour products from a first removal site, and to remove the solid pyrolysis residue from two or more separate removal sites in the pyrolysis chamber.

In some embodiments, the system comprises a centrifugal pump and/or electromagnetic induction system for moving the surface of the pyrolysis liquid to move the feedstock from the delivery site through the pyrolysis chamber towards the removal site. The speed of moving the surface determines the residence time of the feedstock. The speed and the residence time can be controlled to ensure a complete liberation of the pyrolysis vapours from the residue.

In some embodiments, the solid/vapour extraction conduit/line is operatively connected to a suction fan or a blower. In some embodiments, the extraction system comprises a cyclone connected to outlet end of the solid/vapour extraction conduit/line, wherein the cylone is also connected to a condenser system, and the condenser system is connected to the suction fan or blower.

In some embodiments, the extraction system comprises one or more extractor heads attached to one or more of the vapour/solid removal lines/conduits to remove the pyrolysis vapours, or the pyrolysis vapours and solid pyrolysis residue together from the surface of the molten pyrolysis liquid. In some embodiments, the extractor head has a nozzle extending into the pyrolysis chamber and having an inlet just above the surface of the pyrolysis liquid.

To gain a better understanding of the invention described herein, the following examples are set forth. It will be understood that these examples are intended to describe illustrative embodiments of the invention and are not intended to limit the scope of the invention in any way.

EXAMPLES

FIG. 1 depicts a schematic view of one embodiment of a system for conducting the process of the present invention, comprising a pyrolysis chamber 10 having a top 14, a bottom 15, and side walls 16, filled with molten metal 11. A screw feeder system 18 located on a side of pyrolysis chamber for feeding the feedstock 20 above the surface 22 of the pyrolysis liquid, and an extraction system 24 for removing the pyrolysis vapours and solid residues from the pyrolysis chamber via one or more suction nozzles (not shown). The extraction system 24 comprises a vapour/solid removal line/conduit 25, a cyclone 28, condenser 32 and suction fan 33.

The screw feeder system 18 is configured such that air cannot enter the pyrolysis chamber via screw feeder 42, for example using valves such as rotary vanes, double dump valves, and other methods known in the art.

The screw feeder mechanism 42 conveys feedstock 20 and places it onto pyrolysis liquid 11. The feedstock is pyrolyzed into pyrolysis vapour products comprising hydrocarbons and other vapours such as $H_2$, CO and $CO_2$, and solid pyrolysis residue comprising char, sand and other components, after coming in contact with pyrolysis liquid 11. Water present in the feedstock also evaporates. The solid pyrolysis residue comprising sand and other solid materials float on the molten metal. The pyrolysis vapours and the pyrolysis residue are removed together from the pyrolysis chamber 10 using extraction system 24. The suction or extraction force for the vapour/solid residue removal operation is provided by fan 33. The vapour and solid residue are together removed as stream 25*a* via Solids/vapour extractor line/conduit and directed to a cyclone 28 maintained at the same temperature as the pyrolysis chamber to separate solids from vapour products. The collected solids exit the system via solids removal line 30. The vapours are condensed by condenser system 32 to pyrolysis oil 35. The non-condensable vapours such as methane, propane etc. are separated via line 34, which may be sent to burner 13 to minimise the energy requirements of the pyrolysis process or may be used to generate electricity or both. Moreover, the treated sand or other recovered solids may also be combusted by burners 13 if any residual carbon and heavy residue is present in the treated sand.

Figure 2:
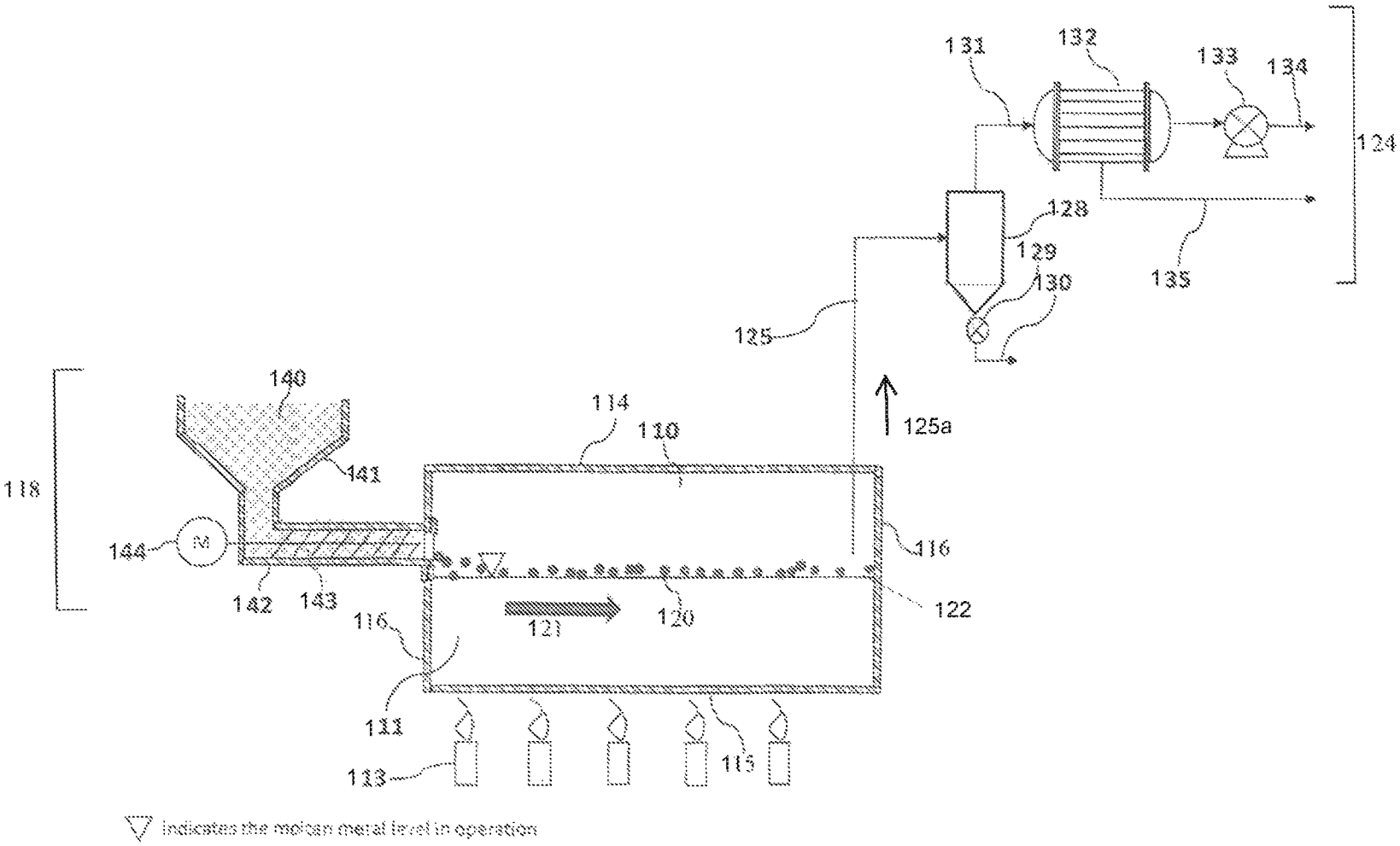
FIG. 2 illustrates a schematic view of a system in accordance with another embodiment of the present invention.

FIG. 2 depicts a schematic view of another embodiment of the system for conducting the process of the present invention, comprising a pyrolysis chamber 110 having a top 114, a bottom 115, and side walls 116, filled with molten metal 111. A screw feeder system 118 located on a side of pyrolysis chamber for feeding the feedstock 120 above the surface 122 of the pyrolysis liquid at a delivery site, and an extraction system 124 comprising a vapour/solid removal line/conduit 125, a cyclone 128, condenser system 132 and suction fan 133, for removing the pyrolysis vapours and solid residues as stream 125*a* from the pyrolysis chamber at a removal side located at a side of the chamber opposite to the delivery site. This embodiment can be optionally adapted to move the feed stock from the delivery site to removal site as depicted by arrow 121.

Figure 3:
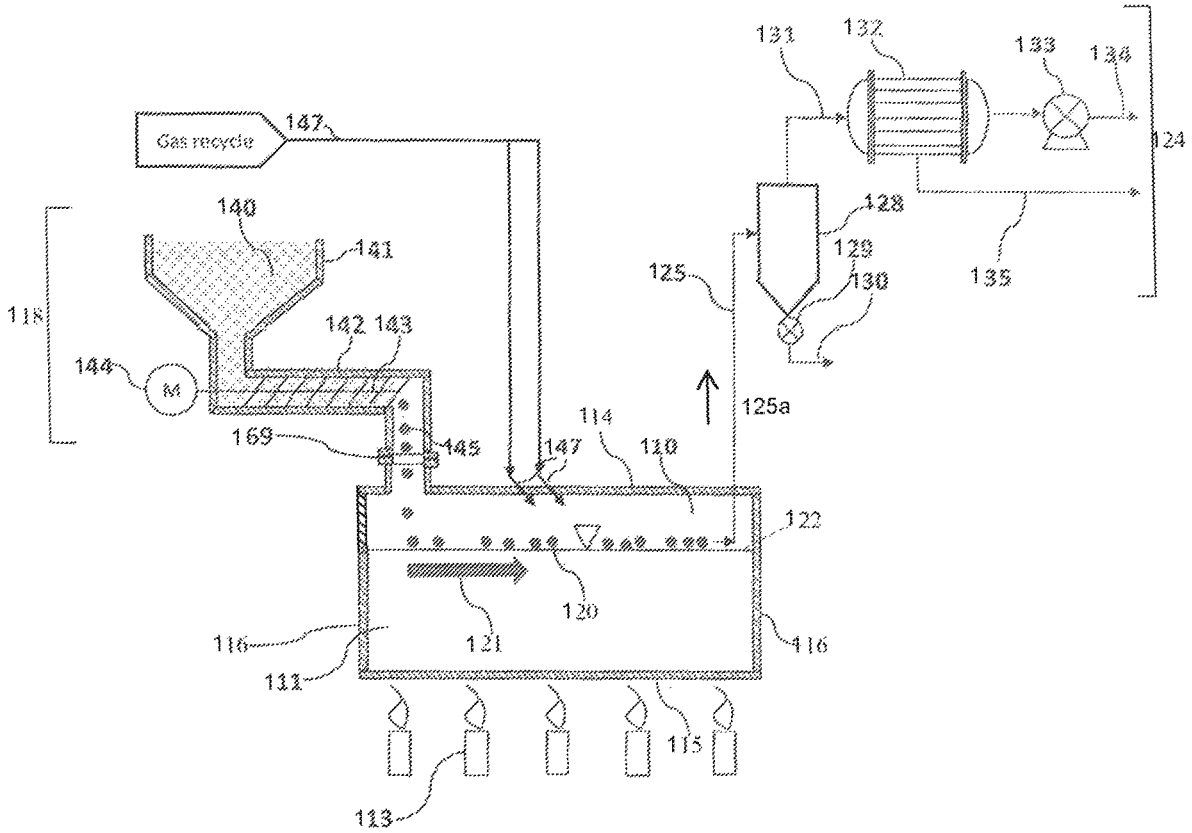
FIG. 3 illustrates a schematic view of a system in accordance with another embodiment of the present invention.

FIG. 3 depicts a schematic view of an alternative embodiment of the system depicted in FIG. 2, wherein the screw feeder is communicating via top 114 of the pyrolysis chamber 110, and wherein some or all of the non-condensable vapour products/gases 134 (other gas sources may also be used) are recycled to pyrolysis chamber 110 via gas recycle injection line 147 to: (a) to increase the shear forces on feedstock within pyrolysis chamber; and (b) increase the suction fluid velocity in solids/vapour extractor system 124.

Figure 4:
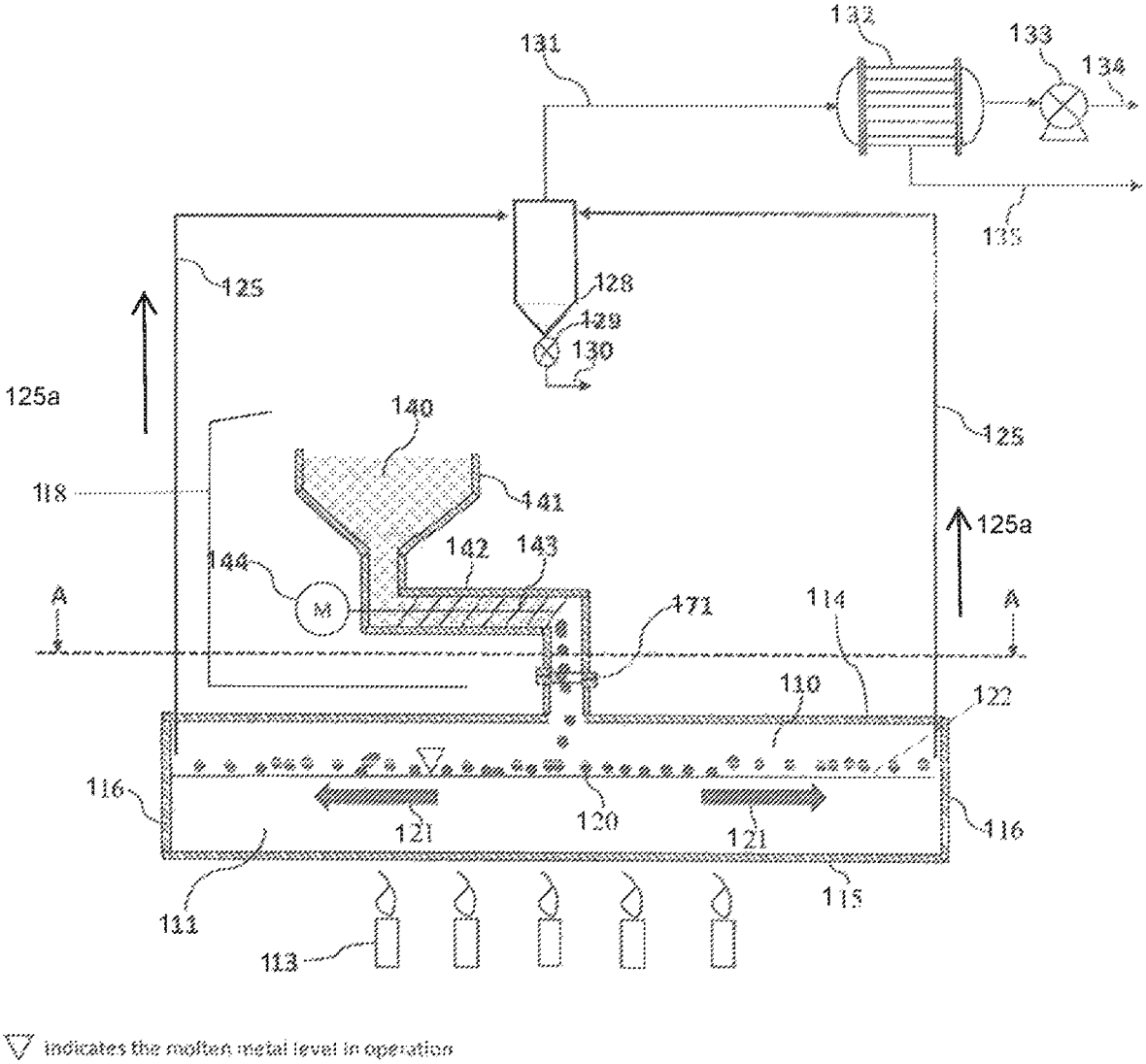
FIG. 4 illustrates a schematic view of a system in accordance with another embodiment of the present invention.

FIG. 4 depicts a schematic view of another alternative embodiment of the system depicted in FIG. 2, wherein the screw feeder is communicating via top 114 of the pyrolysis chamber 110, and wherein the solids and vapours are removed from the corners or the sides of pyrolysis chamber 110 as streams 125*a* via the solids/vapour extractor line(s)/conduit(s) 125, using extractor system 124.

Figure 5:
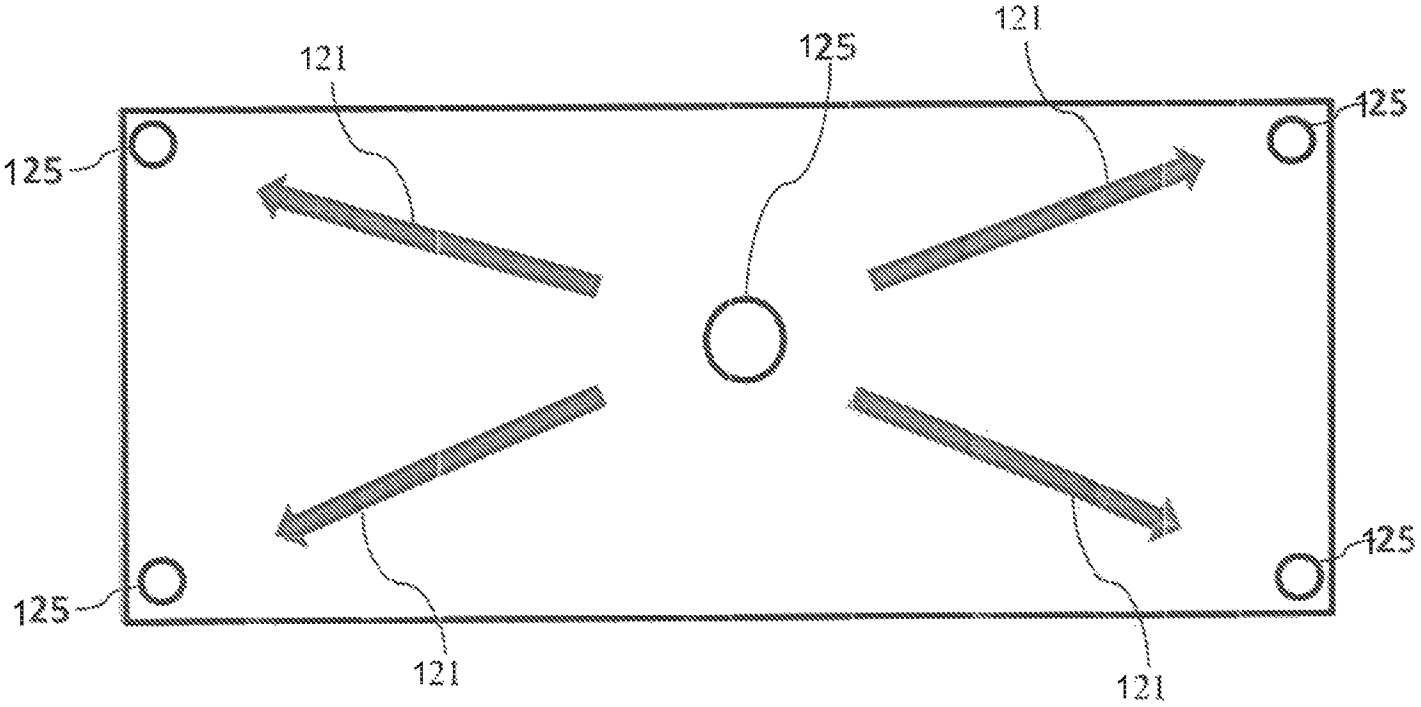
FIG. 5 illustrates a schematic top view of section A-A as indicated on FIG. 4.

FIG. 5 depicts a schematic top view of section A-A as indicated in FIG. 4; also shown is the direction of travel of feedstock 120 by arrows 121 to four solids/vapour removal sites, wherein the solids and vapours are removed from the surface of pyrolysis liquid 111 via lies/conduits 125.

Figure 6:
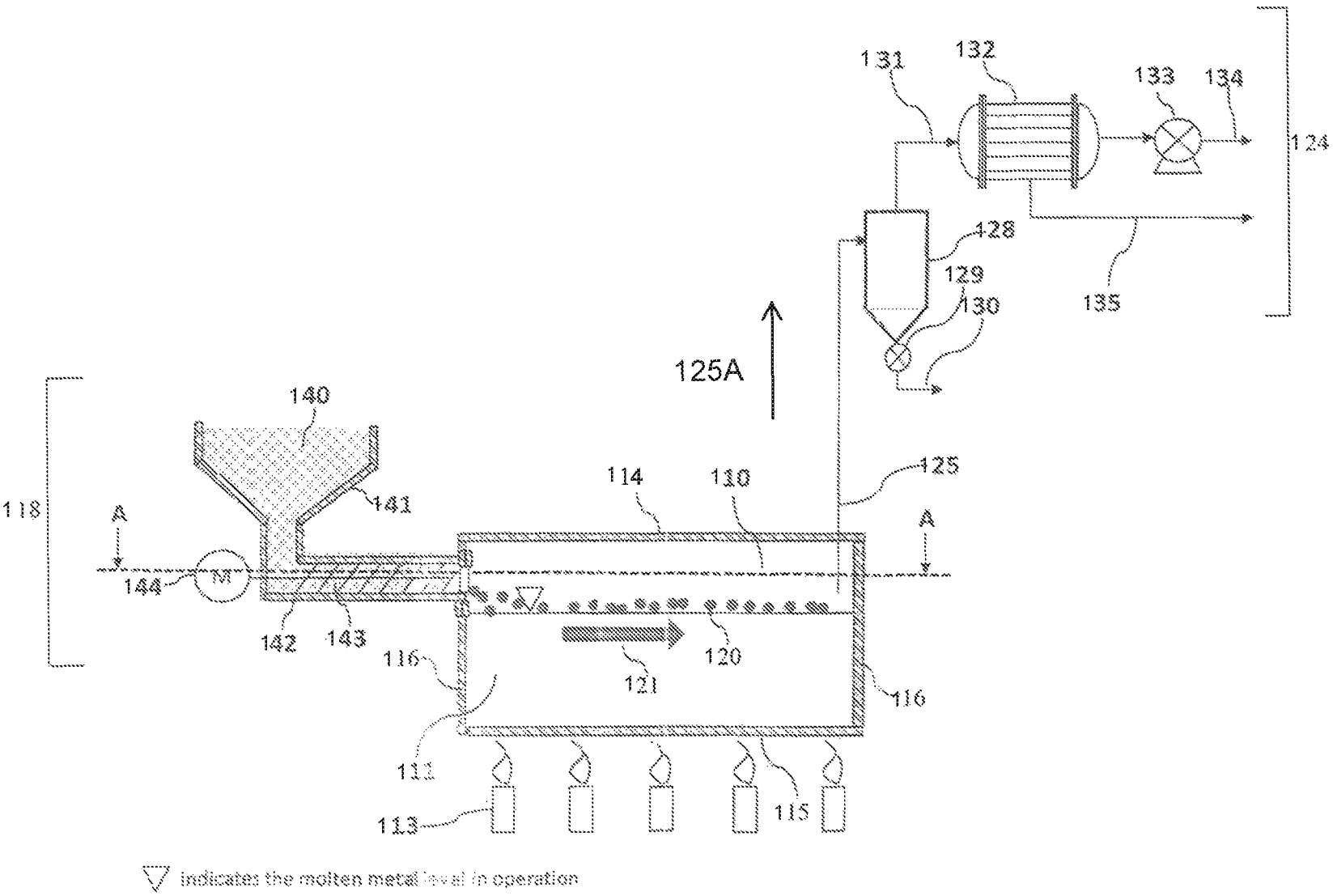
FIG. 6 illustrates a schematic view of a system in accordance with another embodiment of the present invention.

FIG. 6 depicts a schematic view of another alternative embodiment of the system depicted in FIG. 2, wherein the pyrolysis chamber 110 is split into lanes or sections by separation wall(s).

The separation wall(s) ensures that feedstock within pyrolysis chamber 110 moves along the surface of pyrolysis liquid 111 in a defined manner.

Figure 7:
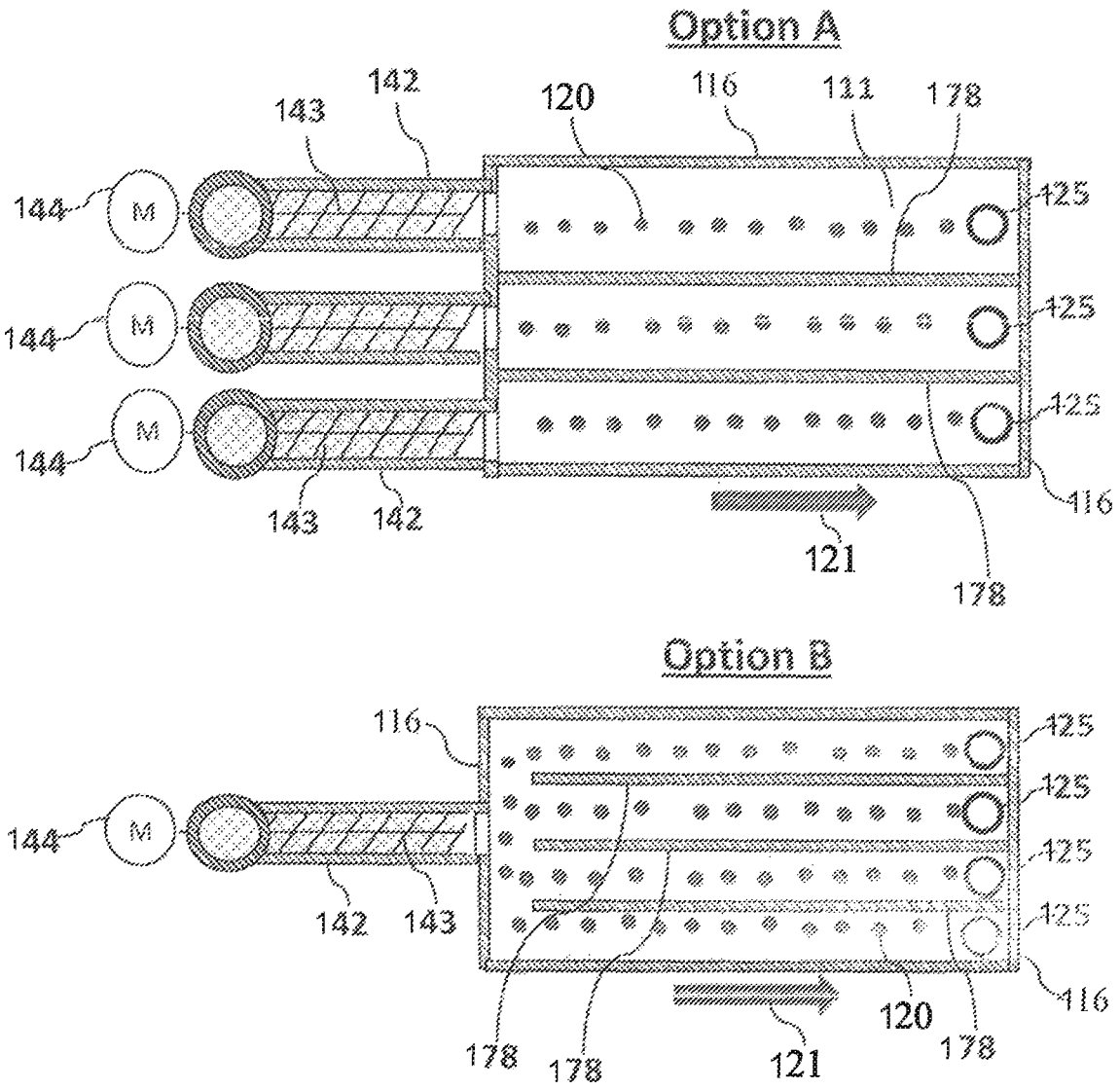
FIG. 7 illustrates a schematic top view of section A-A as indicated on FIG. 6. Shown are two options as to how feedstock within pyrolysis chamber may be distributed.

FIG. 7 depicts a schematic top view of section A-A as indicated in FIG. 6, showing separation wall(s) 178*a* and 178 *b* with two different options. In option "A" each lane is fed by one screw feeder 142 of the feeder system 118, and the treated sand and other solids are removed at a respective removal site via lines/conduits 125 using a solids/vapour extractor system 124. In option "B", on the other hand, one screw feeder 142 feeds more than one lane, each of which is equipped with a respective removal site for the solids/vapour streams via lines/conduits 125.

Figure 8:
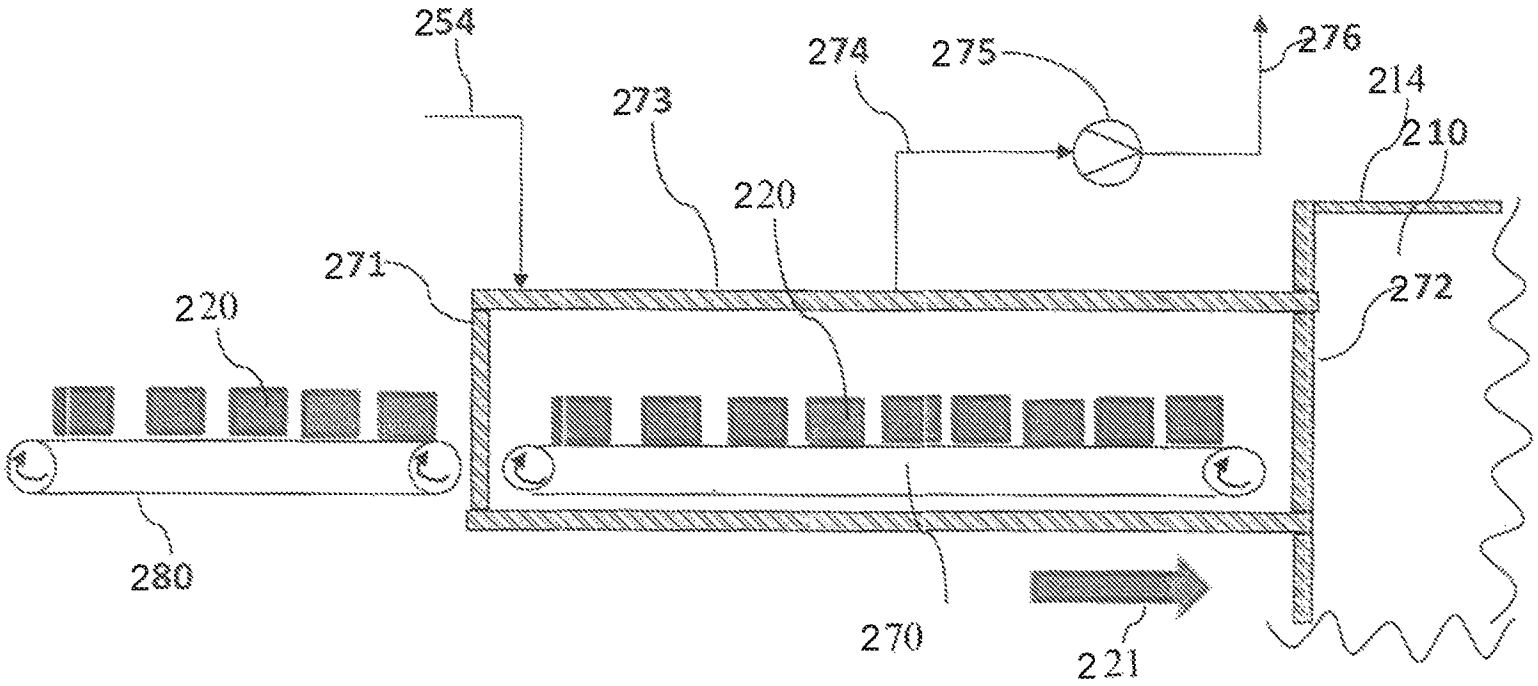
FIG. 8 illustrates a schematic view a feedstock feeder mechanism in accordance with another embodiment of the present invention.

FIG. 8 depicts a schematic view of a feedstock feeder mechanism using an air lock system, wherein the feedstock 220 is fed into a charging vessel 273 by a belt conveyor 280 or by other means. Once charging vessel 273 is fully charged with feedstock 220, an inlet lock 271 is closed, the air in the vessel is removed by vacuum pump 275 and subsequently broken/purged with e.g. nitrogen from the inert gas addition line 254 until an inert atmosphere is achieved in charging vessel 273.

Once the above steps are completed, the outlet lock 272 is opened and feedstock 220 in charging vessel 273 are charged via conveyor 270 into the pyrolysis liquid (not shown). Inerting gas sweep of the charging vessel 273 is also possible.

Figure 9:
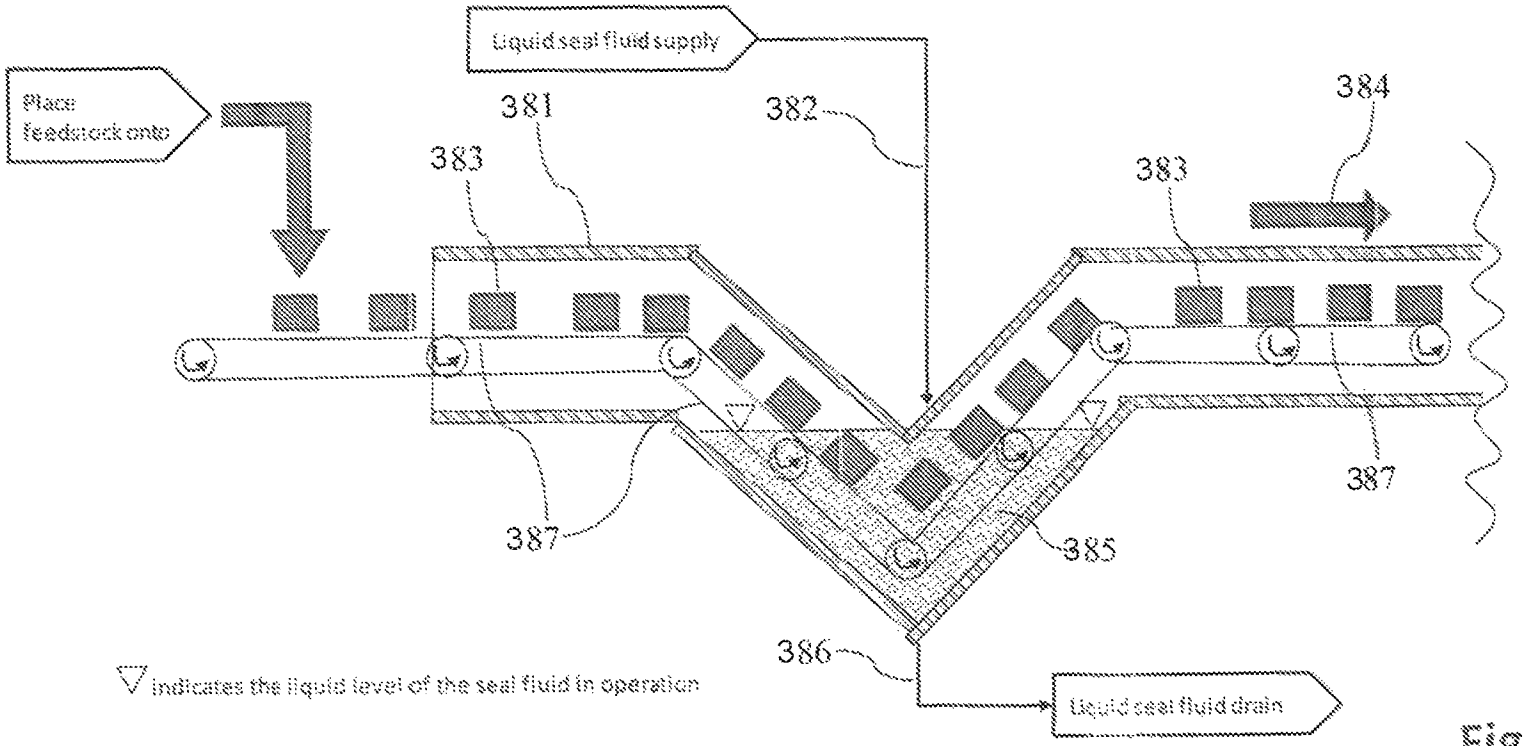
FIG. 9 illustrates a schematic view a feedstock feeder mechanism in accordance with another embodiment of the present invention.

FIG. 9 depicts a cross-sectional view of another exemplary feedstock feeder mechanism, wherein the feedstock is moved via feedstock conveyor 387 through the liquid seal fluid 385, which provides an air tight seal of the pyrolysis chamber towards the atmosphere. The liquid seal fluid can either be water or an organic liquid.

Figure 10:
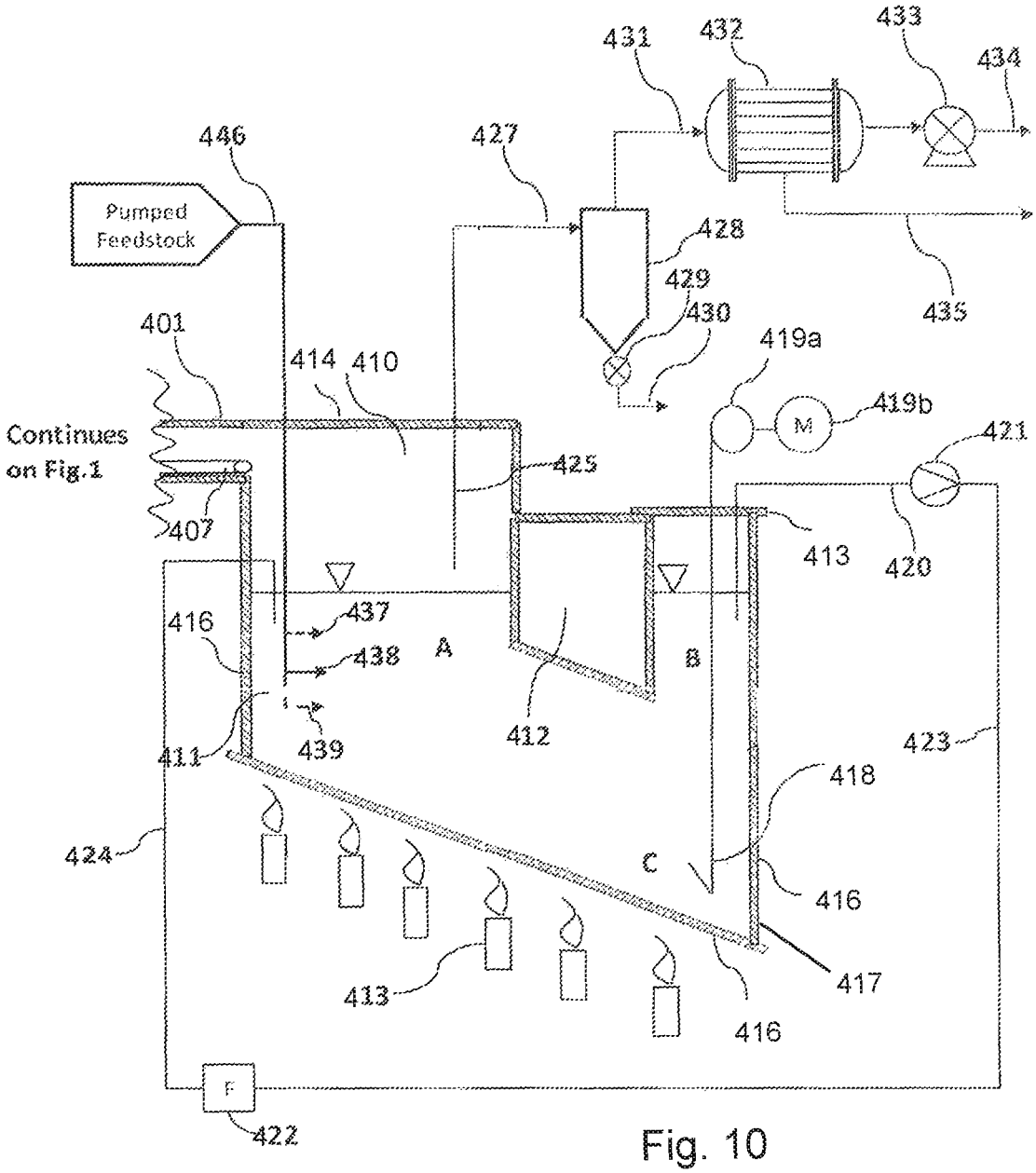
FIG. 10 illustrates a schematic depiction of a system in accordance with another embodiment of the present invention.

FIG. 10 depicts a schematic view of another embodiment of the system for conducting the process of the present invention, comprising a pyrolysis chamber 410 having a top 414, a bottom 415, and side walls 416, filled with molten salt. In this example, a feedstock is transported by feedstock conveyor 407 into the pyrolysis chamber and/or pumped via line 446 at one or more of the desired depths 437, 438 and 439. Sand and other solid residue materials denser than the molten salt sink to the bottom of pyrolysis chamber. The bottom of the pyrolysis chamber can be optionally sloped to create a low area "C", such that the solid residue accumulates in the low area from where this material may be removed by solids removal device 418 having a collection portion. Alternatively, the molten salt may be pumped via recirculation pump 421 through recirculation line (pump discharge pipe 423 and filter discharge 424) equipped with filter 422 to remove suspended solid materials such as sand and carbon. Alternatively the solid residue can be removed through one or more drain points 417 provided in the chamber. Alternatively the solid residue can be removed from the low area via a removal line/conduit (not shown). The pyrolysis chamber can be divided into two portions A and B by a divider 412 extending from the top into the chamber. The top of the portion "B" can be covered with a removal cover 413. The pyrolysis vapours are removed from the liquied via line/conduit 425 with the help of extractor system 424.

Figure 11:
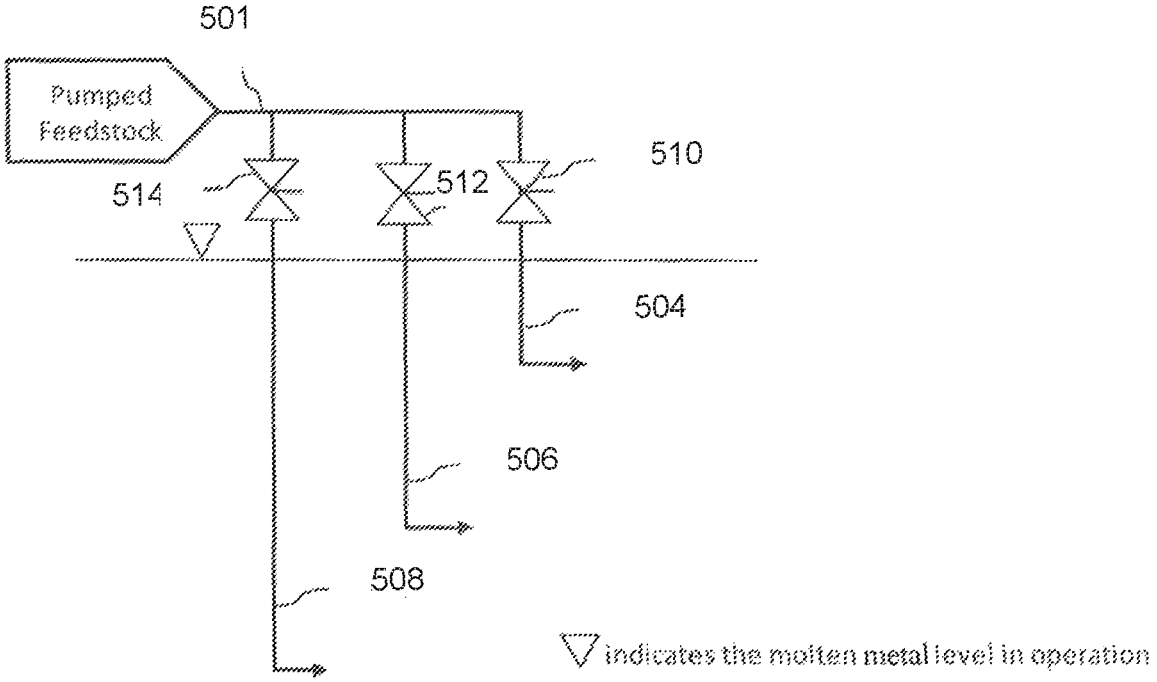
FIG. 11 illustrates a schematic depiction of a feedstock feeder mechanism in accordance with another embodiment of the present invention.

FIG. 11 depicts another exemplary feedstock feeder mechanism, comprising pumped feedstock addition line 501 composed of two or more lines (504, 506 and 508), which terminate in different depths of pyrolysis liquid. Valve(s) 510, 512, and 514 control the flow of the feedstock to the various pumped feedstock addition line(s).

Figure 12:
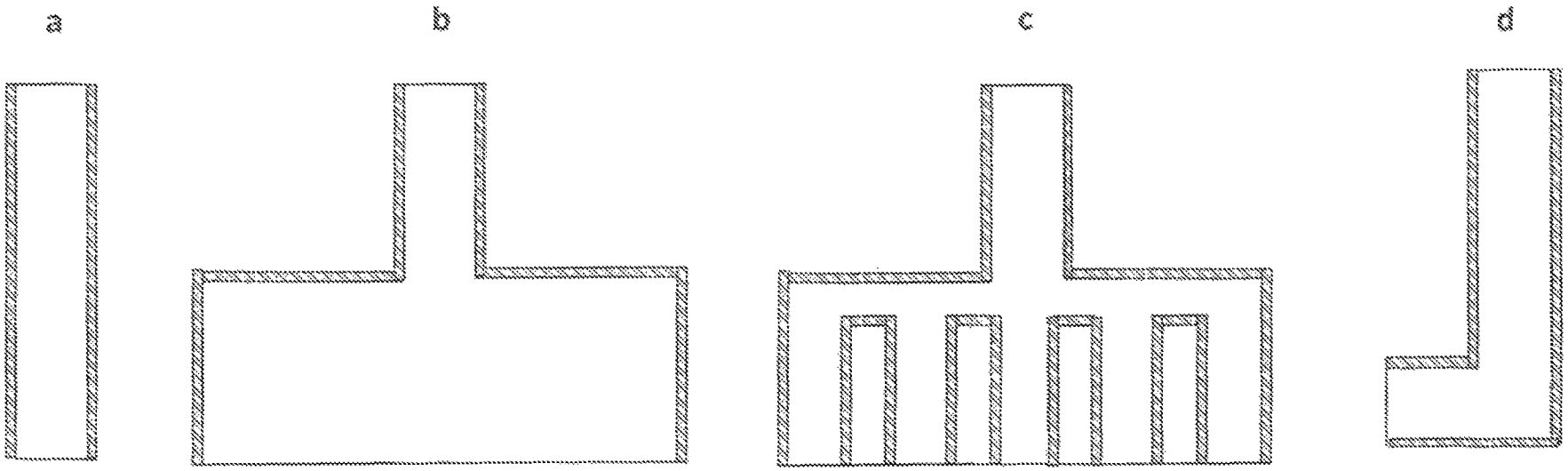
FIG. 12 illustrates a schematic view of the extractors of the solids/vapour extractor system in accordance with four different embodiments of the present invention.

FIG. 12 depicts a cross-sectional drawing showing four different embodiments of the extractors of the solids/vapour extractor system.

DRAWINGS LEGEND

10, 110, 410—Pyrolysis chamber
11, 11, 411—Pyrolysis liquid
13, 113, 413—Burners or heaters
14, 114, 414—Pyrolysis chamber top wall
15, 115, 415—Pyrolysis chamber bottom wall
16, 116, 416—Pyrolysis chamber side wall
20, 120, 420—Feedstock
21, 121, 421—Direction of travel of feedstock
25, 125, 425—Solids/vapour extractor line/conduit
25*q*, 125*a*, 425*a*—Solids/vapour stream
28, 128, 428—Cyclone
29, 129, 429—Cyclone rotary valve
30, 130, 430—Solids removal line
31, 131, 431—Cyclone vent
32, 132, 432—Condenser system
33, 133, 433—Fan
34, 134, 434—Non-condensable line
35, 135, 435—hydrocarbon(s)/Pyrolysis oil
40, 140—Feedstock (screw feeder)
41, 141—Feedstock hopper
42, 142—Screw feeder
43, 143—Screw of screw feeder
44, 144—Screw feeder motor
147—Gas recycle injection line
169—Flange for screw feeder
178—Separation wall(s)
270—Conveyor
271—Inlet lock
272—Outlet lock
273—Charging vessel
274—Line to vacuum pump
275—Vacuum pump
276—Vacuum pump outlet
381—Continuous charging mechanism
382—Liquid seal fluid supply
383—Feedstock
384—Direction of travel of conveyor 7
385—Liquid seal fluid
386—Liquid seal fluid drain
387—Feedstock conveyor
412—Portions A and B separator
413—Portion B cover
417—Drain
418—Solids removal device
419*a*—Part of solids removal device
419*b*—Motor
420—Pump suction pipe
421—Recirculation pump
422—Filter
423—Pump discharge pipe
424—Filter discharge
446—Pumped feedstock addition line
510, 512, 514—Valves
504—Pumped feedstock injection line 1
506—Pumped feedstock injection line 2
510—Pumped feedstock injection line 3

The invention claimed is:

1. A process of recovering one or more hydrocarbons from a feedstock comprising an oil sand, an oil shale source material, lignite, or heavy hydrocarbon residue, the process comprising:

removing air from said feedstock;

introducing the feedstock in a pyrolysis chamber containing a pyrolysis liquid comprising a molten metal, said pyrolysis chamber being maintained at a temperature from 400-750° C.;

contacting said feedstock with said pyrolysis liquid for a time sufficient to convert the oil sand, the oil shale source material, the lignite, or the heavy hydrocarbon residue into pyrolysis vapour products comprising the one or more hydrocarbons, and a solid pyrolysis residue which floats on the surface of the pyrolysis liquid;

removing the pyrolysis vapour products and the solid pyrolysis residue together from the surface of the pyrolysis liquid via suction;

separating the solid pyrolysis residue from the pyrolysis vapour products; and recovering the one or more hydrocarbons from the pyrolysis vapour product.

2. The process of claim 1, wherein the solid pyrolysis residue is separated from the pyrolysis vapour products via a cyclone.

3. The process of claim 2, further comprising separating hydrocarbon liquids and non-condensable hydrocarbon gases from said pyrolysis vapour products.

4. The process of claim 1, wherein the molten metal is molten zinc, molten lead, molten tin, molten aluminum or molten alloys thereof.

5. The process of claim 1, wherein the process further comprises introducing the feedstock onto the surface of the pyrolysis liquid in the pyrolysis chamber.

6. The process of claim 5, wherein the feedstock is introduced onto the surface of the pyrolysis liquid via at least one feeding member adapted to remove air from said feed stock, wherein said at least one feeding member is at least one screw feeder or at least one delivery line/conduit.

7. The process of claim 1, wherein the process further comprises introducing the feedstock below the surface of the pyrolysis liquid in the pyrolysis chamber.

8. The process of claim 7, wherein the feedstock is pumped below the surface of the pyrolysis liquid via at least one delivery line, the delivery line optionally being configured to introduce the feedstock at multiple depths below the surface of the pyrolysis liquid.

9. The process of claim 1, wherein the feedstock is introduced to a delivery site in the pyrolysis chamber, and the pyrolysis vapour products and the solid pyrolysis residue are removed from a removal site in the pyrolysis chamber, wherein:

the delivery site is located at one side of the pyrolysis chamber, and the removal site is located at an opposing side of the pyrolysis chamber, or the delivery site is located at a middle portion of the top of said pyrolysis chamber, and the removal site is located at least one side ends of the pyrolysis chamber.

10. The process of claim 9, further comprising moving the feedstock from the delivery site through the pyrolysis chamber towards the removal site by moving the surface of the pyrolysis liquid via centrifugal pump and/or by electromagnetic induction.

11. A process of recovering one or more hydrocarbons from a feedstock comprising an oil sand, an oil shale source material, lignite or heavy hydrocarbon residue, the process comprising:

removing air from said feedstock;

introducing the feedstock in a pyrolysis chamber containing a pyrolysis liquid comprising a molten salt, said pyrolysis chamber being maintained at a temperature from 400-750° C.;

contacting said feedstock with said pyrolysis liquid for a time sufficient to convert the feedstock into pyrolysis vapour products comprising one or more hydrocarbons and a solid pyrolysis residue;

allowing the solid pyrolysis residue to sink towards the bottom of the pyrolysis chamber;

removing the pyrolysis vapour product from the pyrolysis liquid via suction;

removing the solid pyrolysis residue via a solid residue removal line/conduit or device; and recovering the one or more hydrocarbons from the pyrolysis vapour products.

12. The process of claim 11 wherein the molten salt comprises a lithium salt.

13. The process of claim 11, wherein the process further comprises introducing the feedstock onto and/or below the surface of the pyrolysis liquid in the pyrolysis chamber.

14. The process of claim 13, wherein the feedstock is introduced onto the surface of the pyrolysis liquid via at least one feeding member adapted to remove air from said feed stock, wherein said at least one feeding member is at least one screw feeder or at least one delivery line/conduit.

15. The process of claim 13, wherein the feedstock is pumped below the surface of the pyrolysis liquid via at least one delivery line, the delivery line optionally being configured to introduce the feedstock at multiple depths below the surface of the pyrolysis liquid.

16. The process of claim 11, wherein the feedstock is introduced to a delivery site in the pyrolysis chamber, and the pyrolysis vapour products and the solid pyrolysis residue are removed from a removal site in the pyrolysis chamber, wherein:

the delivery site is located at one side of the pyrolysis chamber, and the removal site is located at an opposing side of the pyrolysis chamber, or the delivery site is located at a middle portion of the top of said pyrolysis chamber, and the removal site is located at the side ends of the pyrolysis chamber.

17. The process of claim 16, further comprising moving the feedstock from the delivery site through the pyrolysis chamber towards the removal site by moving the surface of the pyrolysis liquid via centrifugal pump and/or by electromagnetic induction.

18. The process of claim 12 wherein the molten salt is LiCl-KCl.

* * * * *